US007794238B2

(12) United States Patent
Chen et al.

(10) Patent No.: US 7,794,238 B2
(45) Date of Patent: Sep. 14, 2010

(54) ELECTRICAL CONNECTOR AND ELECTRICAL CONNECTOR ASSEMBLY HAVING TERMINALS WITH ELASTICITY

(75) Inventors: Ming-Ching Chen, Tu-cheng (TW); Chi-Nan Liao, Tu-cheng (TW); Chih-Hsiang Ho, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/387,122

(22) Filed: Apr. 28, 2009

(65) Prior Publication Data

US 2009/0269987 A1 Oct. 29, 2009

(30) Foreign Application Priority Data

Apr. 28, 2008 (TW) ..... 97207280 U

(51) Int. Cl.
*H01R 12/00* (2006.01)

(52) U.S. Cl. ..... 439/74; 439/660

(58) Field of Classification Search ..... 439/66, 439/660, 74
See application file for complete search history.

(56) References Cited

U.S. PATENT DOCUMENTS 7,494,347 B1 * 2/2009 Wang et al. ..... 439/74
2004/0142586 A1 * 7/2004 Yu ..... 439/74

* cited by examiner

*Primary Examiner*—Ross N Gushi
(74) *Attorney, Agent, or Firm*—Ming Chieh Chang; Wei Te Chung; Andrew C. Cheng

(57) ABSTRACT

An electrical connector includes an insulative housing (21) defining a longitudinal direction, a plurality of terminals (22) arranged along the longitudinal direction. Each of the terminals defines a retaining portion (221) with barbs interfering with the housing along a transverse direction perpendicular to the longitudinal direction, a contacting portion (223) and a connecting portion (222) connecting with the retaining portion and the contacting portion. The connecting portion is narrower than the other portions along the transverse direction.

15 Claims, 7 Drawing Sheets

ELECTRICAL CONNECTOR AND ELECTRICAL CONNECTOR ASSEMBLY HAVING TERMINALS WITH ELASTICITY

BACKGROUND OF THE INVENTION

1. Field of the Invention

The present invention relates to electrical connectors, especially to an electrical connector and electrical connector assembly having terminals with elasticity.

2. Description of the Relate Art

U.S. Pat. No. 5,145,384 issued on Sep. 8, 1992, discloses a conventional connector assembly mounted separately on two Printed Circuit Boards (PCBs) and including a first electrical connector and a second electrical connector engaging with the first electrical connector. The first electrical connector has an insulative housing and a plurality of blade-shaped rigid first terminals retained in the insulative housing. The second electrical connector has a plurality of second blade-shaped terminals retained in a corresponding insulative housing for engaging with the first terminals. The second terminal defines two contacting arms for holding the first terminal when the connector assembly mating together. Each of the first terminals has a finger-shaped contacting portion received between the contacting arms of the second terminal.

However, the contacting arms of the second terminal would unsteadily engage with the finger-shaped contacting portion of the first terminal, because the contacting arms may lose intrinsic elasticity after repetitiously pressed apart by the rigid finger-shaped contacting portion.

Therefore, an improved electrical connector and an electrical connector assembly thereof is desired to overcome the disadvantages of the relate arts.

SUMMARY OF THE INVENTION

An object of the present invention is to provide an electrical connector having terminals with elasticity.

In order to achieve above-mentioned object, an electrical connector in accordance with a preferred embodiment of the present invention mounted on the PCB for engaging with a mating connector includes an insulative housing and a plurality of terminals arranged along a longitudinal direction. Each of the terminals defines a retaining portion with barbs interfering with the housing along a transverse direction perpendicular to the longitudinal direction, a contacting portion and a connecting portion connecting with the retaining portion and the contacting portion. The connecting portion is narrower than the other portions along the transverse direction. When the electrical connectors mate together, the terminal would adjust moving offset itself after engaging with corresponding terminal of the mating connector for keeping steadily engaging relationship thereof.

Other objects, advantages and novel features of the invention will become more apparent from the following detailed description of the present embodiment when taken in conjunction with the accompanying drawings.

DETAILED DESCRIPTION OF THE INVENTION

Figure 1:
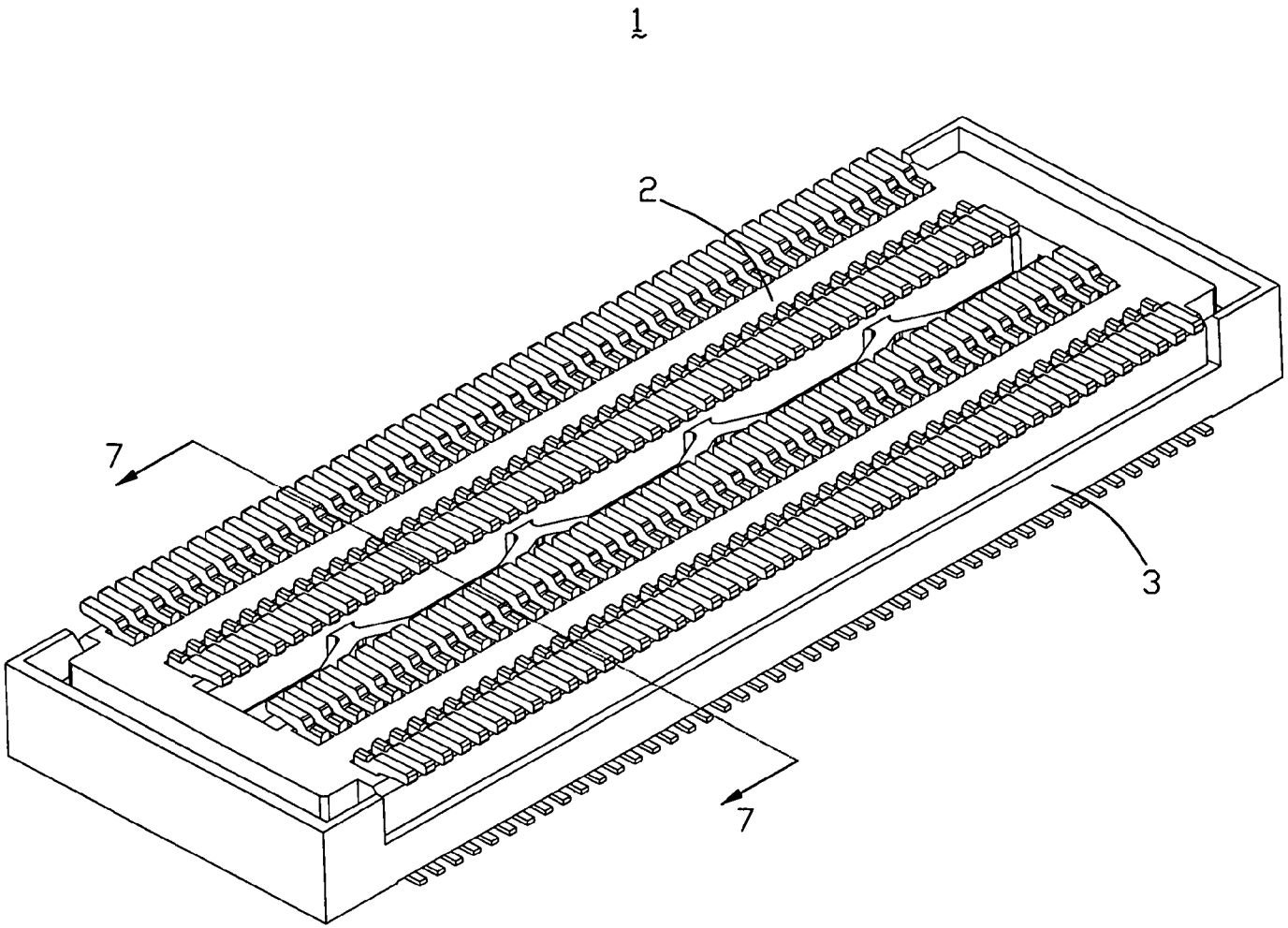
FIG. 1 is a perspective assembled view of an electrical connector assembly in accordance with the preferred embodiment of the present invention.

Reference will now be made to the drawing figures to describe the preferred embodiment of the present invention in detail.

Figure 2:
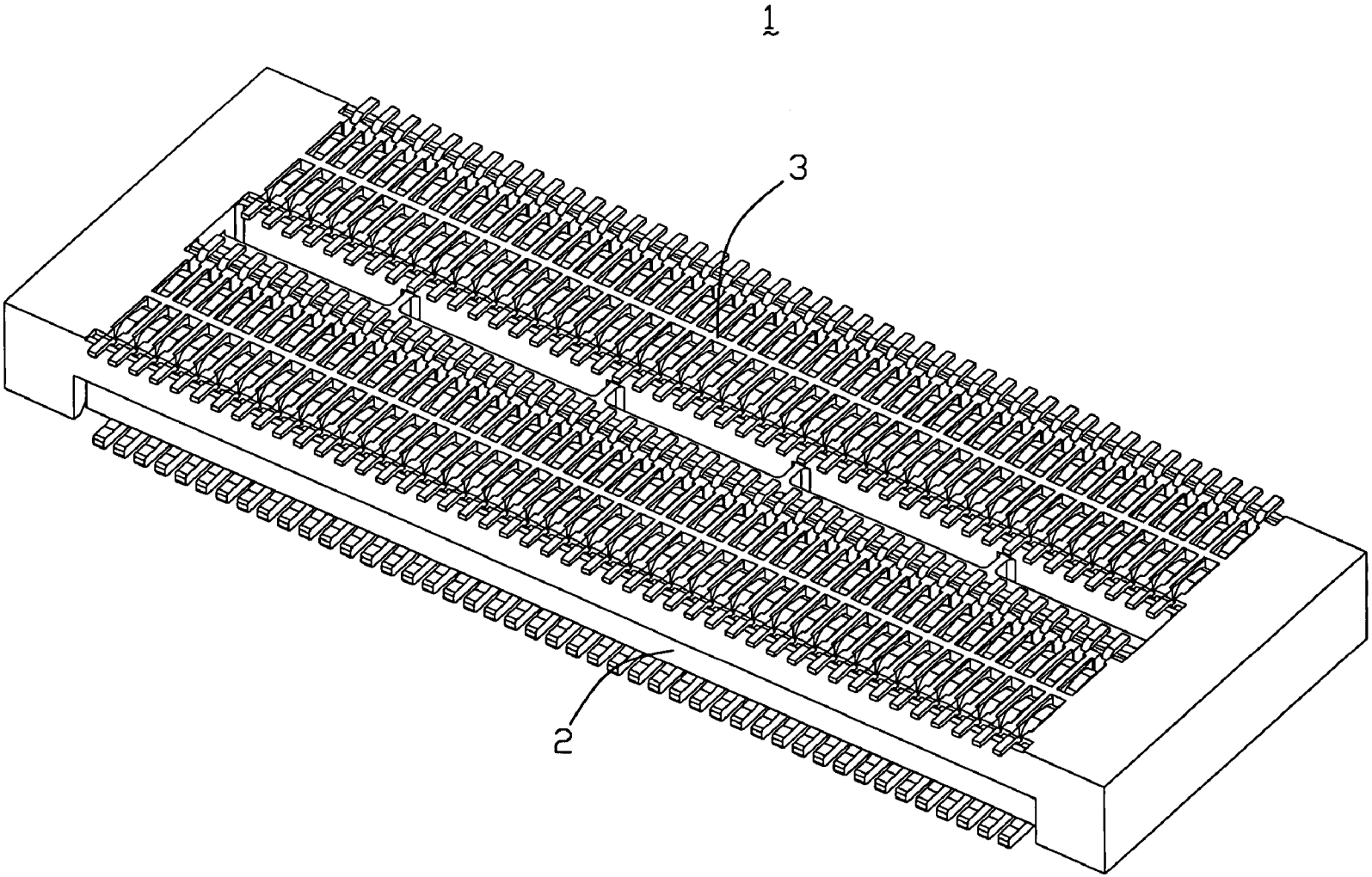
FIG. 2 is another perspective assembled view of the electrical connector assembly.

Referring to FIG. 1 and FIG. 2, an electrical connector assembly 1 of an embodiment of the invention includes a first electrical connector 2 and a second electrical connector 3 engaging with the first electrical connector 2.

Figure 3:
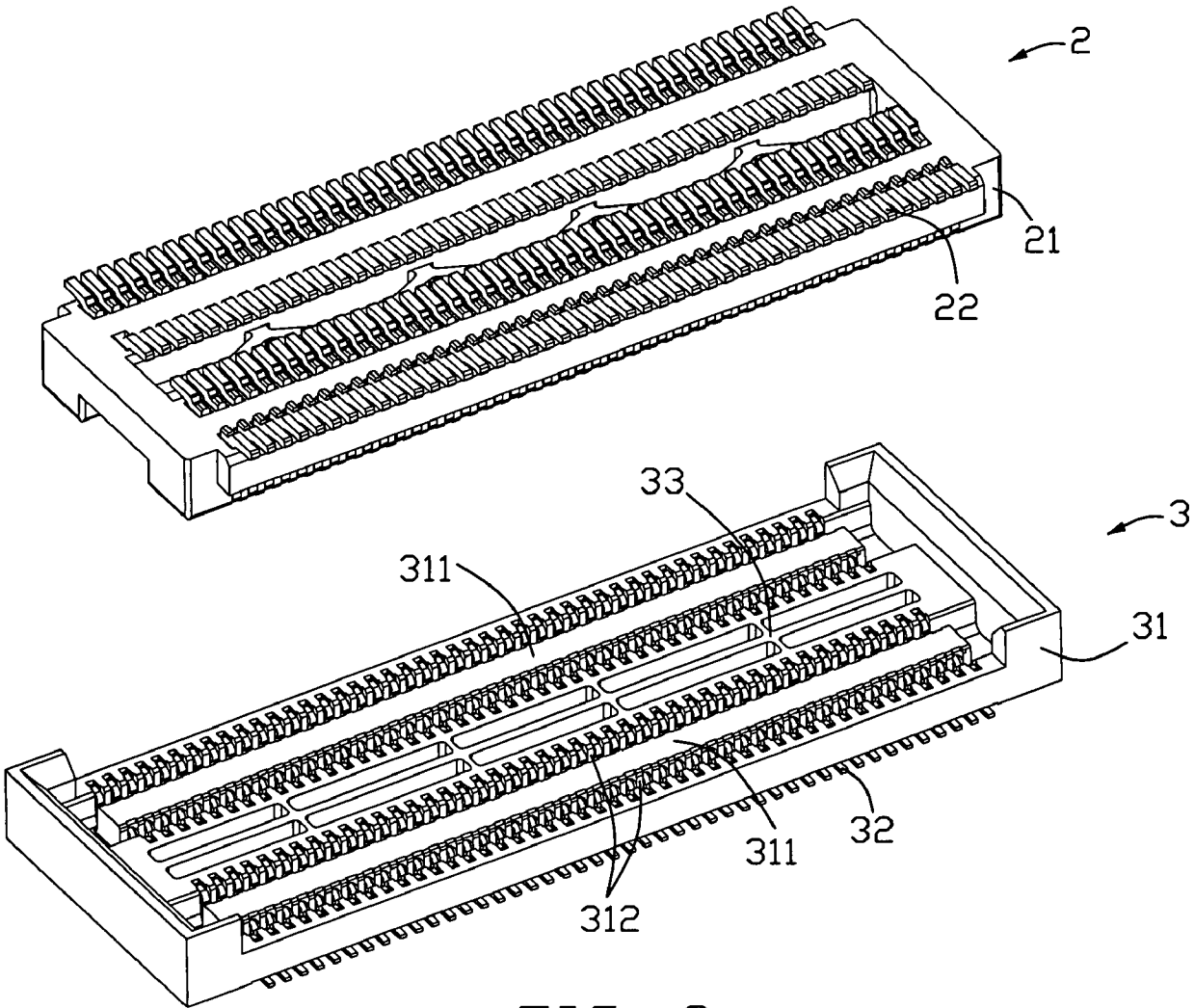
FIG. 3 is an exploded perspective view of the electrical connector assembly of FIG. 1.
Figure 4:
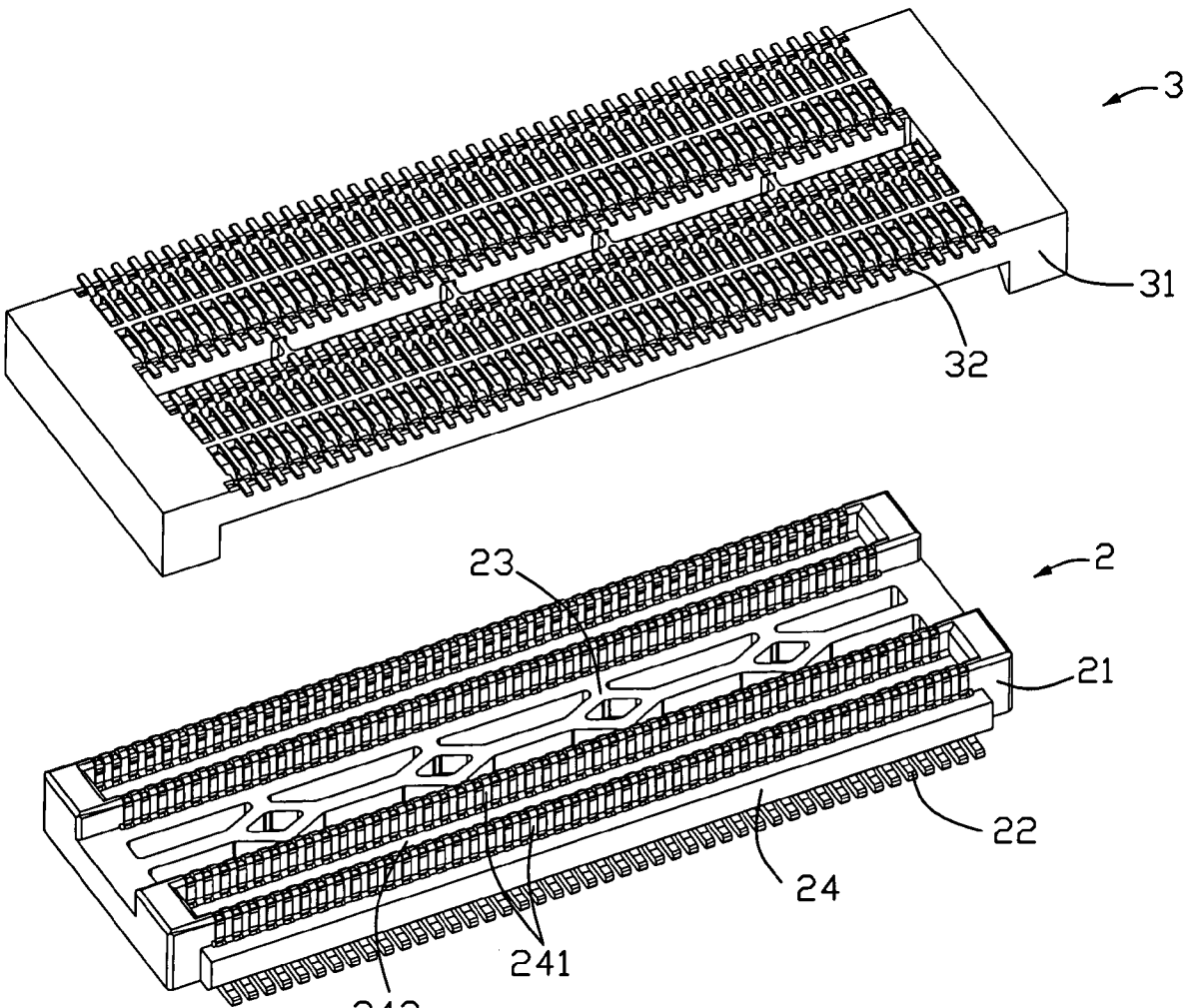
FIG. 4 is an exploded perspective view of the electrical connector assembly of FIG. 2.

Referring to FIG. 3 and FIG. 4, the first electrical connector 2 defines a longitudinal first insulative housing 21 and a plurality of first terminals 22 arranged in the first housing along the longitudinal direction. The second electrical connector 3 defines a longitudinal second insulative housing 31 and a plurality of elastic second terminals 32 arranged in the second housing along the longitudinal direction.

Figure 5:
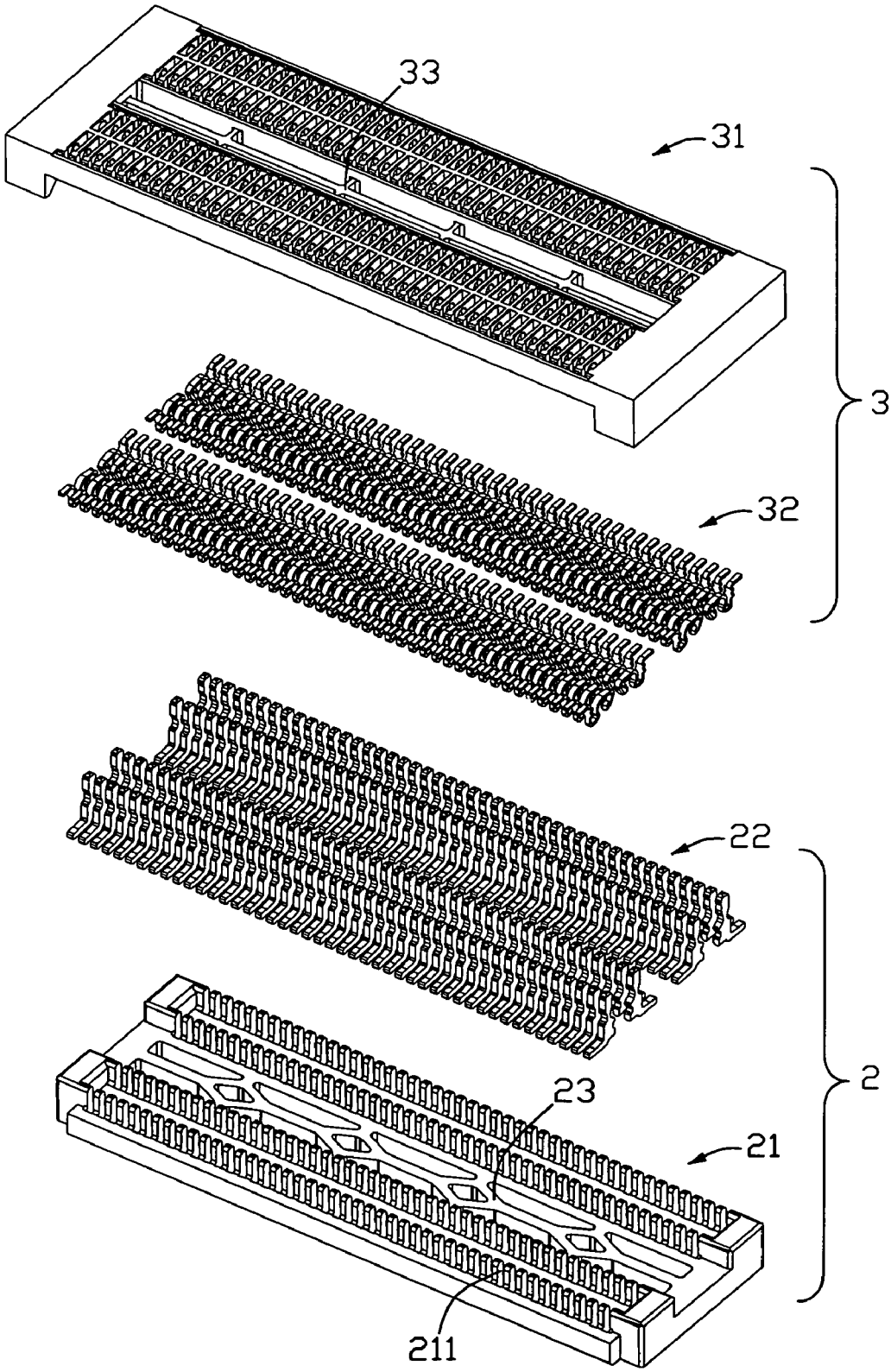
FIG. 5 is an exploded, perspective view of the electrical connector assembly of FIG. 4.
Figure 6:
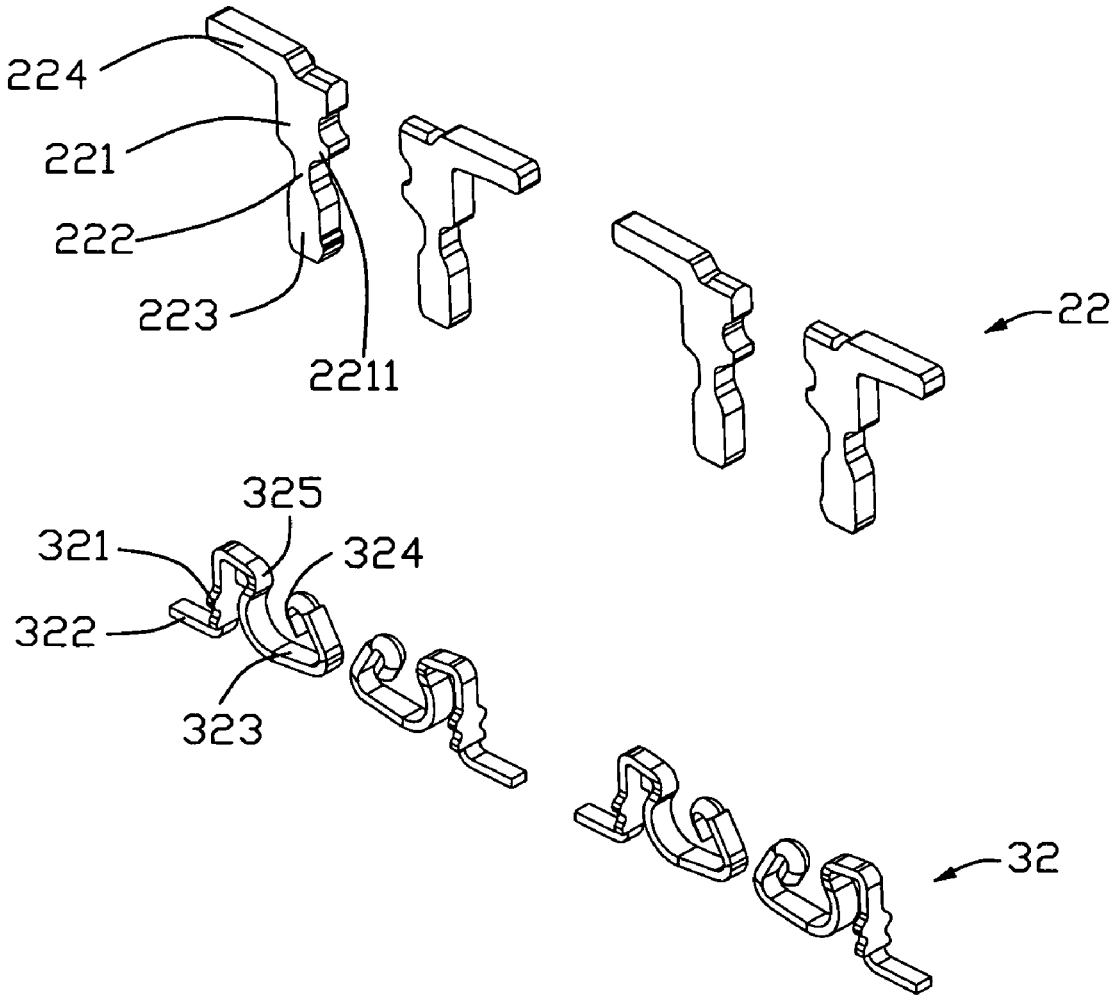
FIG. 6 is a perspective view of terminals of the electrical connector assembly of FIG. 5.

Referring to FIG. 6, the first terminal 22 includes a retaining portion 221, a contacting portion 223 uprightly extending from one end of the retaining portion, a connecting portion 222 connecting with said retaining portion and contacting portion and a soldering portion 224 perpendicularly from another end of the retaining portion. Combination with FIGS. 4 and 5, the first housing 21 defines two mating portions 24 unitarily connecting together with a middle portion 23 of ribs configuration for preventing the insulative housing from being distorted. Each mating portion 24 extends along the longitudinal direction of the housing and has two side walls 241 along the longitudinal direction, thereby a mating cavity 242 defined between the side walls. The side walls 241 define a plurality of slots 211 therealong for the terminal 22 received in thereof. Each of the retaining portions 221 is retained in the slot with two barbs 2211 interfered with the housing along a transverse direction perpendicular to the longitudinal direction. The contacting portion 223 extends upright and defines contacting points protruding along the transverse direction at two lateral sides thereof for engaging with the second terminal.

Referring to FIG. 6, the second terminal 32 has a retaining portion 321, a soldering portion 322 extending outwards from one end of the retaining portion, an elastic contacting arm 323 folding and extending from another end of the retaining portion. Combination with FIGS. 3 and 7, the second housing 31 defines two mating portions 311 unitarily connecting together with a middle portion 33 of ribs configuration. Each mating portion 311 extends along the longitudinal direction and concaves two receiving slots 312 extending along the longitudinal direction with a tongue portion between the two receiving slots, thereby the second terminals 32 arrange along the longitudinal direction in the second housing and each defines two opposite contacting points 324, 325 protruding into the receiving slot along the transverse direction. The retaining portion 321 of the second terminal 32 has a plurality of barbs interfered with the second housing along the longitudinal direction.

Figure 7:
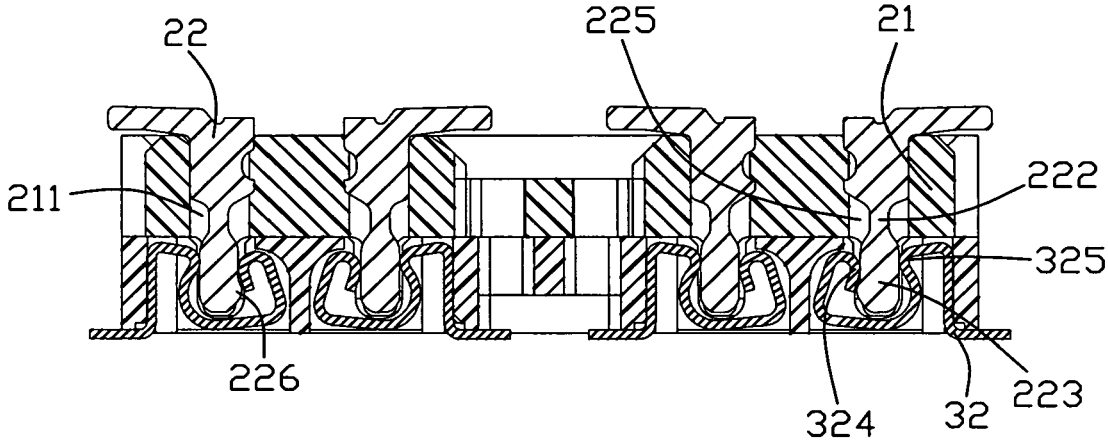
FIG. 7 is a cross-section view of the electrical connector assembly taken along line 7-7 of FIG. 1.

Referring to FIG. 7, the first terminal 22 and the second terminal 32 engage with each other when two electrical connectors mate together. The contacting points 324, 325 engage with the contacting points of the contacting portion 223 in the transverse direction. Just part of the contacting portions 223 has embossing portion 226 protruding along the transverse direction and being distal from the connecting portion 222 compared with the contacting points of the first terminal. So the embossing portion 226 engages below the contacting point 324 for preventing the two electrical connectors from being detached.

Said connecting portion 222 is narrower than the first contacting portion 223 defined by two arc cutouts 225 of the first terminal concaved inwards at two lateral sides thereof in the transverse direction, thereby coming into being a neck portion at the middle of the first terminal. So the contacting portion 223 unitary with the connecting portion could elastically and lightly moving compared to the retaining portion for adjusting an engaging position, when the contacting portion 223 is inserted between the contacting portions 324,325. And the connecting portion 222 is received in the slot 211 for well controlling a moving offset thereof and surrounding by the first insulative housing 21, which could stop the connecting portion from being overly distorted when the second terminal 32 press the first contacting portion 223.

However, the disclosure is illustrative only, changes may be made in detail, especially in matter of shape, size, and arrangement of parts within the principles of the invention.

What is claimed is:

1. An electrical connector comprising:

an insulative housing defining a mating portion and a longitudinal direction;

a plurality of terminals arranged in the insulative housing along the longitudinal direction, the terminal comprising a retaining portion with barbs interfering with the housing along a transverse direction perpendicular to the longitudinal direction, a contacting portion disengaging with the insulative housing directly and a connecting portion connecting with the retaining portion and the contacting portion in a mating direction perpendicular to the transverse direction and the longitudinal direction;

wherein the connecting portion is narrower than the contacting portion along the transverse direction.

2. The electrical connector as described in claim 1, wherein the connecting portions of the terminals are surrounded by the insulative housing and the contacting portions expose to the mating portion with contacting points.

3. The electrical connector as described in claim 2, wherein the insulative housing comprises two mating portions and each comprises two side walls to receive the terminals, the mating portions are arranged side-by-side along the transverse direction.

4. The electrical connector as described in claim 3, wherein the terminal comprises an embossing portion protruding along the transverse direction on the contacting portion and the embossing portion is distal from the connecting portion compared with the contacting point.

5. The electrical connector as described in claim 3, wherein the insulative housing comprises a middle portion of rib configuration integrally connecting with the mating portions.

6. An electrical connector assembly comprising:

a first electrical connector comprising a first insulative housing defining a mating portion and a longitudinal direction, a plurality of first terminals arranged in the insulative housing along a longitudinal direction and comprising a retaining portion with barbs interfering with the housing along a transverse direction perpendicular to the longitudinal direction, a first contacting portion;

a second electrical connector for mating with the first connector comprising a second insulative housing and a plurality of elastic second terminals comprising a retaining portion with barbs interfering with the housing along the longitudinal direction and a second contacting portion for engaging with the first contacting portion;

wherein the first terminal comprises a neck portion connecting with the retaining portion and the first contacting portion, and the neck portion is narrower than the first contacting portion along the transverse direction.

7. The electrical connector assembly as described in claim 6, wherein the neck portions of the terminals are surrounded by the first insulative housing and the first contacting portions expose to the mating portion with contacting points.

8. The electrical connector assembly as described in claim 7, wherein the first insulative housing comprises two mating portions and each comprises two side walls to receive the first terminals, the mating portions are arranged side-by-side along the transverse direction.

9. The electrical connector assembly as described in claim 8, wherein the first terminal comprises an embossing portion protruding along the transverse direction on the first contacting portion and the embossing portion is distal from the neck portion compared with the contacting point.

10. The electrical connector assembly as described in claim 8, wherein the first insulative housing comprises a middle portion of rib configuration integrally connecting with the mating portions.

11. An electrical connector comprising:

an insulative housing defining a mating portion and a longitudinal direction;

a plurality of terminals arranged in the insulative housing along a longitudinal direction, the terminal comprising a retaining portion with barbs interfering with the housing along a transverse direction perpendicular to the longitudinal direction, a contacting portion disengaging with the insulative housing directly and a connecting portion connecting with the retaining portion and the contacting portion;

wherein the terminal comprises two arc cutouts concaved inwards at two lateral sides thereof in the transverse direction and formed between the retaining portion and the contacting portion.

12. The electrical connector as described in claim 11, wherein the cutouts of the terminals are surrounded by the insulative housing and the contacting portions expose to the mating portion with contacting points.

13. The electrical connector as described in claim 12, wherein the insulative housing comprises two mating portions and each comprises two side walls to receive the terminals, the mating portions are arranged side-by-side along the transverse direction.

14. The electrical connector as described in claim 13, wherein the terminal comprises an embossing portion protruding along the transverse direction on the contacting portion and the embossing portion is distal from the connecting portion compared with the contacting point.

15. The electrical connector as described in claim 13, wherein the insulative housing comprises a middle portion of rib configuration integrally connecting with the mating portions.

* * * * *